United States Patent [19]

Holce et al.

[11] 4,409,577

[45] Oct. 11, 1983

[54] SWITCH HOUSING HAVING RECESSED CONDUCTOR TERMINALS

[75] Inventors: Thomas J. Holce, Portland; Charles M. Huckins, Tigard, both of Oreg.

[73] Assignee: Sentrol, Inc., Portland, Oreg.

[21] Appl. No.: 271,574

[22] Filed: Jun. 8, 1981

[51] Int. Cl.[3] ..... H01H 45/04

[52] U.S. Cl. ..... 335/202; 335/205

[58] Field of Search ..... 335/202, 205, 153; 174/52 R; 248/506, 27; 200/293, 294, 295; 339/128

[56] References Cited

U.S. PATENT DOCUMENTS

| | | | |
|---|---|---|---|
| 3,271,708 | 9/1966 | McCormick | 335/205 |
| 4,210,888 | 7/1980 | Holce | 335/205 |
| 4,335,270 | 6/1982 | Holce et al. | 335/202 |

*Primary Examiner*—Harold Broome

*Attorney, Agent, or Firm*—Chernoff, Vilhauer, McClung, Birdwell & Stenzel

[57] ABSTRACT

A housing for an electrical circuit component such as a magnetic contact reed switch for use in a security system. Clamps are provided for connecting the electrical component to conductors of the circuit, with apertures in a wall of the housing permitting insertion of the conductors in the proper location relative to the clamps. Clamping screws for securing the electrical connections are accessible only through apertures provided in the opposite ends of the housing. Recessed location of the clamping screws protects against inadvertent or surreptitious short circuiting around the switch. A flexibly attached mounting bracket includes a latch to hold the housing alongside the bracket.

11 Claims, 6 Drawing Figures

FIG. 1
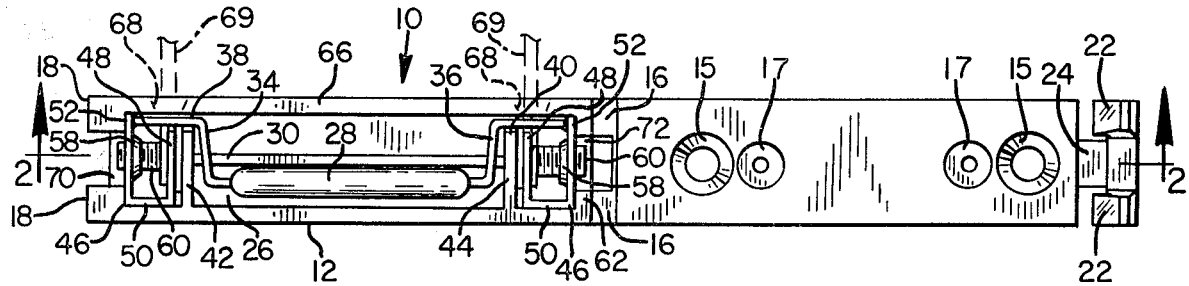
FIG. 2
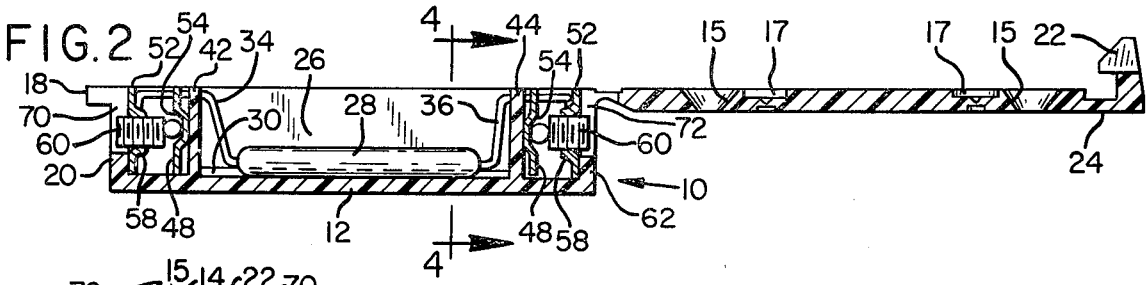
FIG. 6
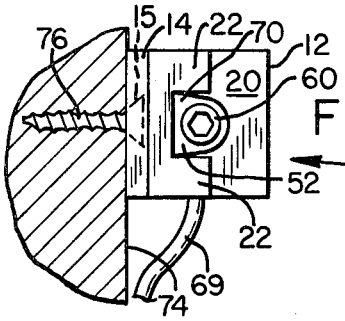
FIG. 4
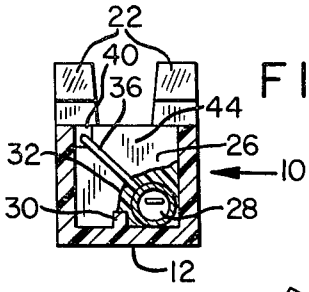
FIG. 5
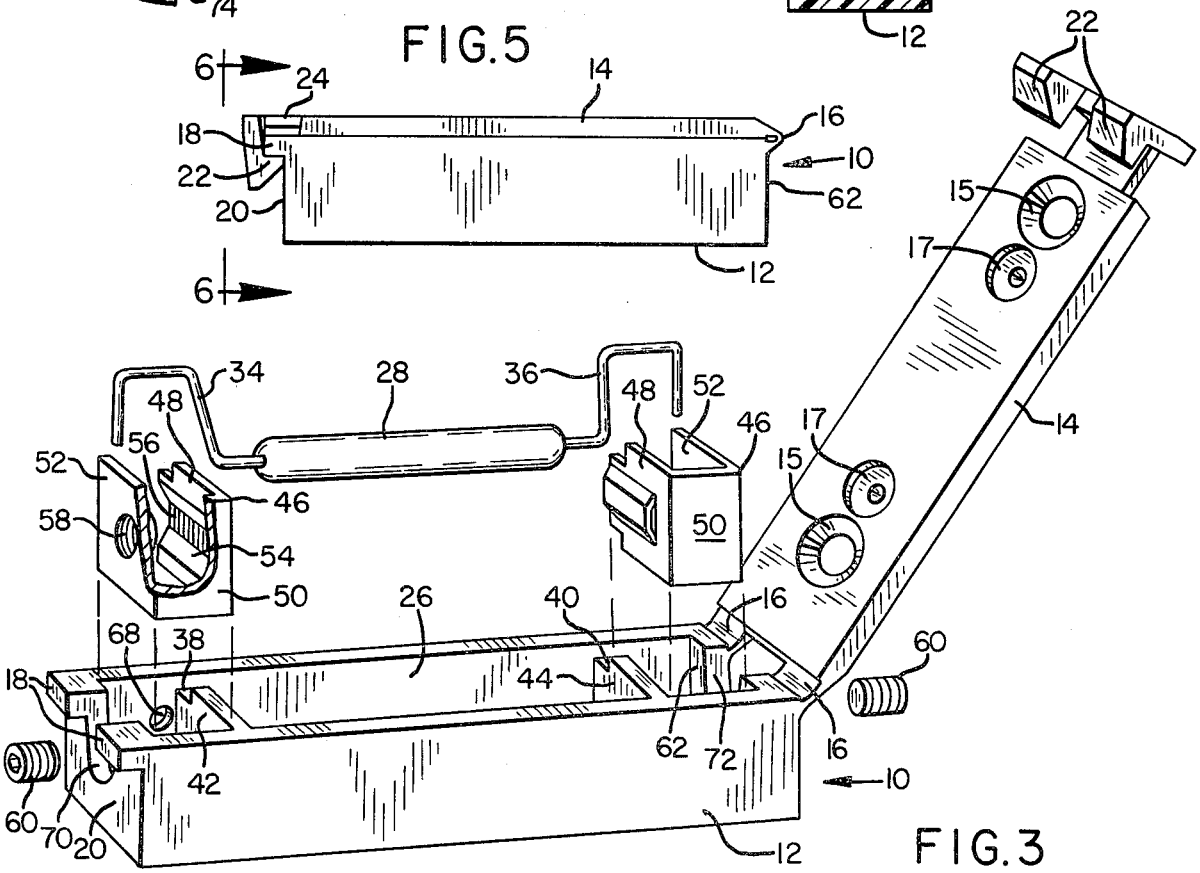
FIG. 3

SWITCH HOUSING HAVING RECESSED CONDUCTOR TERMINALS

BACKGROUND OF THE INVENTION

The present invention relates to housings for electrical circuit components, and particularly to a surface-mountable housing for a magnetic reed switch unit for use in a physical security monitoring alarm system.

Physical security alarm system circuits often incorporate magnetic reed switches sensitive to the position of a magnet carried on a movable object such as a window sash or door. Such magnetic contact switches are commonly mounted in somewhat exposed locations, fastened to the surface of a doorway or window frame.

Since the door and window monitoring switches are only parts of an alarm circuit which involves other remotely located components, some means must be provided for electrical connection of the switches to the remainder of the circuit. Previously this has commonly been accomplished by connecting wires to externally located screw post terminals. When screw post terminals are used, they are typically left exposed, along with a short bared portion of the electrical conductors of the alarm circuit.

When screw post type terminals are left exposed it is possible to defeat the security system switch by unobtrusively attaching a conductor such as a paper clip to bridge the gap between the terminals. This can be avoided by covering the terminals with a plate such as the one disclosed in Holce et al, U.S. Pat. No. 4,210,888, but such a cover adds to the size of the switch unit and may therefore be undesirable.

Short lengths of wire may be provided extending from a switch housing and the like. Such leads, however, necessitate a solder joint or equivalent connection to the conductors of the alarm circuit. These joints must be covered with some sort of insulation material to protect the circuit, adding inconvenience and time to the process of installing an alarm circuit.

It is often desirable to test operation of each individual switch of such a security circuit. This requires the ability to make electrical contact with the switch leads. While such testing may be made possible by the provision of test points located accessibly in a switch unit, it is sometimes necessary to test a switch while it is in its installed location but disconnected from the alarm circuit. Use of soldered connections is relatively inconvenient when such testing is necessary.

While the magnetic reed switches used in alarm systems may be quite small themselves, the requirements for terminal connections and mounting of a switch in the proper location have previously resulted in relatively large switch units. Such large surface mounted switch units are often easily noticeable, detracting somewhat from the appearance of a building in which they are used.

Another problem with previously known switch units is that mounting such a switch unit on an uneven surface, using screws or similar fasteners extending through a fixed flange of a housing, may result in damaging the switch.

What is desired, therefore, is a small magnetic contact switch unit for inconspicuous surface mounting, which permits electrical connection of the switch into an alarm system circuit without exposing uninsulated portions of the alarm circuit conductors outside the switch housing, which is easily connected to the circuit conductors, and which permits electrical testing of the individual switch without physical removal of the switch from its mounted location as part of a security system, yet provides substantial protection of the electrical terminals against unauthorized bypassing of the switch.

SUMMARY OF THE INVENTION

The present invention overcomes the aforementioned shortcomings and disadvantages of previously known surface-mountable housings for magnetic contact switch units and other electrical components by providing a housing including protected terminals which clamp an electrical conductor between a terminal screw and a jaw of a terminal clamp contained within the housing.

According to the present invention a housing, which may be manufactured preferably of an insulating plastic material, includes a cavity for receiving a magnetic reed switch in a predetermined location. Terminal clamps are held in predetermined locations within the ends of the housing, in alignment with apertures extending through a wall of the housing. This permits insertion of a bared end of a circuit conductor into a position aligned with each of the terminal clamps, while the insulation may be left in place covering all of the conductor which extends outside the housing. The leads from the magnetic reed switch or other electrical device may be joined to the respective terminal clamps by soldering or welding.

Each terminal clamp includes a screw which may be adjusted to clamp one of the conductors of the security circuit or the like against a jaw of the clamp. A channel in the jaw includes a roughened surface to help retain the conductor.

A terminal access aperture is provided in each end of the housing to permit adjustment of the respective clamping screw, although the screw normally remains below the level of the surface of the end wall of the housing. The insulating material of the housing then protects the screw from contact.

The necessary electrical connections may be made using the terminal clamps of the invention more quickly than by soldering to leads extending from the switch unit. At the same time, the terminals are protected against inadvertent or easy short circuiting, yet are exposed suffiiently to permit insertion of test probes to check the operation of the electrical component either while it is still connected in the circuit or after disconnection from the circuit, but without the need to dismount the device from the surface to which it is attached.

A mounting bracket is formed integrally with the housing. It is flexibly connected to the body of the housing by thin portions of the plastic material at one end of the housing. A lip structure extends from the opposite end of the housing, and a pair of resilient hooks are provided on a corresponding end of the bracket, forming a latch to hold the housing closely alongside the bracket. Use of such a bracket avoids application of mechanical stress to the electrical components held within the housing.

It is therefore a principal objective of the present invention to provide an improved housing for magnetic contact switches and the like in which electrical circuit connection terminals are protected yet available for use as test points.

It is another important objective of the present invention to provide a housing for a magnetic contact switch or similar electrical component which permits its interconnection into a circuit without exposing uninsulated portions of circuit electrical conductors.

It is a principal feature of the present invention that it provides a convenient terminal clamp including a channel for receiving a portion of an electrical conductor and a clamping screw for retaining the conductor in electrical contact with the terminal clamp to connect a switch or similar component easily into an electrical circuit.

It is another feature of the present invention that it provides a surface-mountable housing having circuit connection terminals recessed in opposite ends of a housing body in order to make unauthorized short circuiting around an alarm system switch more difficult.

It is a principal advantage of the present invention that it provides greater protection and permits quicker and safer surface-mounted installation of a circuit component than has previously been possible.

It is another advantage of the present invention that it provides an easily manufactured magnetic contact switch unit which is smaller and may therefore be mounted less conspicuously than previously known surface-mounted magnetic contact switch units having screw terminals.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 1 is a side elevational view of a surface-mountable magnetic contact switch unit embodying the present invention.

FIG. 2 is a sectional plan view of the switch unit shown in FIG. 1, taken along line 2—2.

FIG. 3 is a pictorial exploded view, at an enlarged scale, of the switch unit shown in FIG. 1.

FIG. 4 is a sectional end view of the swtich unit shown in FIG. 1, taken along line 4—4 of FIG. 2.

FIG. 5 is a plan view of the switch unit shown in FIG. 1, with the mounting bracket in its latched position.

FIG. 6 is an end elevational view of the switch unit shown in FIG. 5, with the switch unit mounted against a vertical surface.

DETAILED DESCRIPTION OF THE INVENTION

Referring first to FIGS. 1-3, a switch unit 10 embodying the present invention includes an elongate housing body 12 which may be injection molded of a resilient plastic material. A mounting bracket 14 is attached to one end of the body 12 by a flexible hinge 16, essentially a reduced thickness portion of the same material, which provides the necessary amount of flexibility to permit the mounting bracket 14 to be swung to a position parallel with and alongside the elongate housing body 12.

The mounting bracket 14 includes a pair of screw holes 15 and a pair of recesses 16 for receiving nail or tack heads, permitting the housing to be securely mounted using screws or nails without interfering with the ability to swing the body 12 parallel with the mounting bracket 14.

A pair of lips 18 extend outwardly from a first end wall 20 of the body 12, and a corresponding pair of catches 22 are attached to the mounting bracket 14 by a flexible neck 24. This permits the catches 22 to resiliently latch around the lips 18, holding the mounting bracket 14 parallel to and alongside the elongate body 12, as may be seen in FIG. 5.

Within the body 12 a centrally located cavity 26 is provided to receive an electrical component such as a glass encapsulated magnetic reed switch 28. A raised rib 30 is provided along the bottom of the cavity 26 to assure proper location of the reed switch 28 therein. The reed switch 28 may be secured in position by potting material 32, as shown in FIG. 4.

Leads 34 and 36 extend from respective ends of the reed switch 28 and pass through apertures 38 and 40 provided in dividing walls 42 and 44 which define the ends of the cavity 26. Each lead 34 and 36 is connected, for example by welding, to one of a pair of terminal clamps 46.

Referring particularly to FIG. 3, each of the terminal clamps 46 may be seen to comprise a jaw 48, a base portion 50 and a leg 52 formed preferably of sheet metal. A channel 54 in the jaw 48 extends away from the base portion 50. The interior of the channel 54 preferably has a friction-enhancing surface such as parallel grooves and teeth 56 which extend generally perpendicular to the length of the channel 54. Corner portions of each jaw 48 are cut away in a position aligned with the apertures 38 and 40 to provide clearance for the respective lead 34 or 36. The leads 34 and 36 pass over the respective jaw 48, and are welded to the leg 52 of the clamp 46, thus avoiding interference with insertion of a wire into the channel 54.

The leg 52 includes a threaded boss 58 which extends toward the jaw 48. A clamping screw 60 is fitted in the threaded boss 58 and extends toward the teeth 56 of the channel 54. The clamping screw 60 is preferably small, blunt-ended, headless, and short enough not to extend beyond the respective outer surface of the first end wall 20 or a second end wall 62 located at the opposite end of the elongate body 12.

Between each dividing wall 42 and 44 and the respective end wall 20 or 62, an appropriate amount of space is provided for snugly receiving the respective one of the terminal clamps 46 with its jaw 48 abutting against the respective dividing wall 42 or 44 and its leg 52 fitting adjacent to the interior side of the respective end wall 20 or 62.

An elongate wall 66 of the elongate body 12 includes a pair of conductor apertures 68 which extend therethrough. Each aperture 68 is aligned with the channel 54 of a respective terminal clamp 46, permitting an insulated electrical conductor 69 to be inserted therethrough into the channel 54. The conductor 69 may be clamped into the respective terminal clamp 46 by tightening the screw 60 to hold a bared tip of the conductor 69 against the teeth 56 of the channel 54, completing an electrical connection and a secure mechanical attachment.

The end walls 20 and 62 include respective U-shaped terminal access apertures 70 and 72 giving access to the clamping screws 60, although the clamping screws 60 are located flush with or below the level of the exterior surface of the respective end wall 20 or 62 when tightened against a conductor 69. Although the terminal access apertures 70 and 72 are "U"-shaped, the mounting bracket 14 extends across the open top of each, leaving access available only from the direction facing the respective end wall 20 or 62.

Since the outer end of each clamping screw 60 is below the level of the exterior surface of the respective end wall, the end wall 20 or 62 protects the clamping screw 60 against inadvertent contact. Nevertheless, the apertures 70 and 72 permit a test probe to be brought into electrical contact with each of the clamping screws 60. This provides electrical contact with the respective switch lead 34 or 36, permitting the reed switch 28 to be tested without removal from the circuit or dismounting from proper location for operation of the switch as part of a security system.

The apertures 70 and 72 also permit the conductors 69 to be easily disconnected and reconnected while the switch unit 10 remains in its operatively mounted location. By loosening the respective clamping screw 60 one or both of the circuit conductors 69 may be disconnected from the reed switch 28. The switch 28 may then be tested in its operative location but electrically isolated, and may be simply and quickly reconnected into the security system circuit upon completion of testing. This procedure also permits test actuation and adjustment of the relative positions of the switch unit 10 and an actuating magnet (not shown) without affecting the remainder of an alarm circuit during the testing.

The switch unit 10 of the invention may be mounted securely against a wall such as the wall 74 by the use of screws 76 extending through the screw holes 15. This permits attachment of the switch unit 10 tightly against a surface which need not be absolutely flat, without danger of damage to a fragile electrical component contained within the body 12. Electrical conductors 69 may be connected to the reed switch 28 using the terminal clamps 46 either before or after the housing is swung and latched into a position parallel with and alongside the surface of the mounting bracket 14, depending on convenience. The neck 24 flexes, permitting the catches 22 to ride resiliently over the lips 18. Once latched, the catches 22 securely hold the body 12 in the position shown in FIGS. 5 and 6.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A surface-mountable housing for a small electrical component such as a magnetic reed switch and the like, comprising:

(a) an elongate body having a pair of opposite ends and defining cavity means therein for receiving an electrical component;

(b) a pair of terminal clamps, one of said clamps being located at each of said opposite ends of said elongate body;

(c) conductor aperture means defined in said body for receiving circuit conductors therethrough;

(d) means for holding said terminal clamps in predetermined positions with respect to said conductor aperture means;

(e) gripping means included in each of said terminal clamps for electrically connecting a circuit conductor to a respective one of said terminal clamps; and (f) an end wall at each of said opposite ends of said body, each end wall defining a terminal access aperture providing operative access to the respective one of said gripping means.

2. The housing unit of claim 1 wherein each of said terminal access apertures provides access to the respective gripping means substantially only from the direction toward which the respective one of said opposite ends faces.

3. The housing of claim 1 wherein each said terminal clamp comprises a leg and a jaw extending parallel to said leg, said jaw including channel means for receiving a circuit conductor, and said gripping means including a threaded boss located in said leg and a clamping screw extending through said threaded boss toward said channel means.

4. The housing of claim 3 wherein said channel means includes a friction-enhancing interior surface.

5. The housing of claim 3, each end wall having an exterior surface and each said clamping screw extending no further outward than flush with said exterior surface of the respective end wall.

6. The housing of claim 3, one of said channel means being aligned with each of said conductor aperture means, permitting insertion of a circuit conductor through said conductor aperture means into a position between said clamping screw and said channel means.

7. The housing of claim 1, further comprising a dividing wall isolating each of said terminal clamps from said cavity means, each dividing wall retaining the respective terminal clamp in a predetermined location in said body.

8. The housing of claim 1, further comprising a mounting bracket attached to one of said opposite ends of said elongate body by at least one flexible member, the housing including means associated with the other of said opposite ends for latching said body to said mounting bracket.

9. The housing of claim 1, said means for holding said terminal clamps in predetermined positions including a respective dividing wall located spaced apart from each of said end walls.

10. A magnetically actuated switch unit for use in a security alarm intrusion detection circuit and the like, comprising:

(a) an elongate body having a pair of opposite ends and defining cavity means therein for receiving an electrical component;

(b) a pair of terminal clamps, one of said clamps being located at each of said opposite ends of said elongate body;

(c) a magnetic contact switch mounted in said cavity means, said magnetic contact switch having a pair of leads, each of said leads being electrically connected to one of said terminal clamps;

(d) conductor aperture means defined in said body for receiving circuit conductors therethrough;

(e) means for holding said terminal clamps in predetermined positions with respect to said conductor aperture means;

(f) gripping means included in each of said terminal clamps for electrically connecting a circuit conductor to a respective one of said terminal clamps; and (g) an end wall at each of said opposite ends of said body, each end wall defining a terminal access aperture providing operative access to the respective one of said gripping means.

11. The switch unit of claim 10 wherein each said terminal clamp comprises a leg and a jaw extending parallel to said leg, said jaw including channel means for receiving a circuit conductor, and said gripping means including a threaded boss located in said leg and a clamping screw extending through said threaded boss toward said channel means.

* * * * *